US006588381B2

(12) United States Patent
Komorowski

(10) Patent No.: US 6,588,381 B2
(45) Date of Patent: Jul. 8, 2003

(54) INTERNAL COMBUSTION ENGINE COMBINATION WITH DIRECT CAMSHAFT DRIVEN COOLANT PUMP

(75) Inventor: Jacek S. Komorowski, Bond Head (CA)

(73) Assignee: Litens Automotive, Woodbridge (CA)

( * ) Notice: Subject to any disclaimer, the term of this patent is extended or adjusted under 35 U.S.C. 154(b) by 0 days.

(21) Appl. No.: 10/075,995

(22) Filed: Feb. 15, 2002

(65) Prior Publication Data

US 2002/0108588 A1 Aug. 15, 2002

Related U.S. Application Data

(60) Provisional application No. 60/268,599, filed on Feb. 15, 2001.

(51) Int. Cl.[7] ..... F01P 5/10
(52) U.S. Cl. ..... 123/41.44; 123/198 C
(58) Field of Search ..... 123/41.44, 41.47, 123/198 C

(56) References Cited

U.S. PATENT DOCUMENTS

| | | | | |
|---|---|---|---|---|
| 4,155,333 A | | 5/1979 | Maggiorana | |
| 4,272,224 A | | 6/1981 | Kabele | |
| 4,662,320 A | | 5/1987 | Moriya | |
| 4,848,183 A | | 7/1989 | Ferguson | |
| 4,917,052 A | | 4/1990 | Eguchi et al. | |
| 5,159,901 A | | 11/1992 | Chonan | |
| 5,275,538 A | | 1/1994 | Paliwoda et al. | |
| 5,482,432 A | | 1/1996 | Paliwoda et al. | |
| 5,950,577 A | * | 9/1999 | Sasaki et al. | 123/41.44 |
| 5,951,264 A | | 9/1999 | Hori et al. | |

FOREIGN PATENT DOCUMENTS

| | | | |
|---|---|---|---|
| DE | 41 19 131 A1 | | 12/1992 |
| GB | 1 567 303 | | 5/1980 |
| JP | 9-88582 | * | 3/1997 |

* cited by examiner

*Primary Examiner*—Noah P. Kamen
(74) *Attorney, Agent, or Firm*—Pillsbury Winthrop LLP

(57) ABSTRACT

The combination comprises a valve controlled piston and cylinder internal combustion engine and a coolant system. The engine has an output shaft and a camshaft driven by the output shaft. The system includes a coolant flow path which passes through the engine in cylinder cooling relation and thereafter through a cooling zone. The system includes a coolant pump comprising a pump housing within the flow path, an impeller rotating structure, a pump impeller, and a damper assembly. The rotating structure is mounted directly to the camshaft so as to be rotatably driven thereby about an axis concentric to a rotational axis of the camshaft. The damper assembly is disposed within the pump housing and is rotatable to dampen torsional vibrations of the camshaft.

63 Claims, 13 Drawing Sheets

INTERNAL COMBUSTION ENGINE COMBINATION WITH DIRECT CAMSHAFT DRIVEN COOLANT PUMP

The present application claims priority to U.S. Provisional Application of Komorowski, Serial. No. 60/268,599 filed Feb. 15, 2001, the entirety of which is hereby incorporated into the present application by reference.

FIELD OF THE INVENTION

The present invention relates to a coolant pump for use with an internal combustion engine. More particularly, the present invention relates to a coolant pump that is mounted directly to the camshaft of the internal combustion engine.

BACKGROUND OF THE INVENTION

Conventional coolant pumps, also referred to as water pumps, are typically mounted on the front of the engine frame so that the pump can be operated by a belt drive system. Specifically, the output shaft, or crankshaft, of the engine includes a driving pulley fixed thereto forming part of the drive system. The drive system includes an endless belt that is trained about the driving pulley and a sequence of driven pulley assemblies, each of which is fixed to a respective shaft. The shafts are connected to operate various engine or vehicle accessories. For example, one shaft may drive the water pump, and the other shafts may drive such accessories as an electrical alternator, an electromagnetic clutch of a compressor for an air-conditioning system, or an oil pump of the power steering system. With the abundance of accessories, there is limited space in the front of the engine.

To address this issue, it is known to mount the water pump on the back of the engine and operatively connect the pump shaft to the back end of the camshaft in order to drive the pump shaft. An example of this type of water pump is disclosed in U.S. Pat. No. 4,917,052 to Eguchi et al.

However, the camshaft is subjected to torsional vibrations due to, for example, the natural operating frequency of the engine, cyclic resistance to camshaft rotation, and vibrations occurring in the camshaft drive chain/belt. Such torsional vibrations can cause excessive wear in the chain/belt and at the cam surfaces. As a result, it is known to provide vibration damping means for the camshaft so torsional vibrations may be damped. An example of a camshaft damper is disclosed in U.S. Pat. No. 4,848,183 to Ferguson.

Thus, there is a need for a water pump that can be operated by the camshaft of the internal combustion engine and can also act as a torsional vibration damper for the camshaft. Additionally, there is always a need in the automotive art to provide more cost-effective components. The present invention addresses these needs in the art as well as other needs, which will become apparent to those skilled in the art once given this disclosure.

SUMMARY OF THE INVENTION

It is an object of the present invention to meet the above-described need.

It is desirable to provide a coolant pump that can be mounted on the engine and operatively coupled to the camshaft to eliminate the use of bearings in the pump.

It is further desirable to provide a coolant pump that has a damper assembly that dampens torsional vibrations of the camshaft.

In accordance with the principles of the present invention, this objective is achieved by providing the combination comprising an internal combustion engine having a crankshaft and a camshaft driven by the crankshaft. The combination further comprises a coolant pump comprising a pump housing fixedly mountable to the engine and including an inlet opening to receive coolant and an outlet opening to discharge coolant. An impeller shaft is mounted directly to the camshaft so as to be concentrically rotatably driven thereby. The impeller shaft extends into the housing in a sealing engagement and in an unsupported relation. A pump impeller is operatively mounted to the impeller shaft within the pump housing. The pump impeller is rotatable to draw the coolant into the pump housing through the inlet opening and discharge the coolant at a higher pressure through the outlet opening.

The objective may also be achieved by providing a coolant pump for use with an internal combustion engine having a crankshaft and a camshaft driven by the crankshaft. The coolant pump comprises a pump housing fixedly mountable to the engine and including an inlet opening to receive coolant and an outlet opening to discharge coolant. An impeller shaft is mounted directly to the camshaft so as to be concentrically rotatably driven thereby. The impeller shaft extends into the housing in a sealing engagement and in an unsupported relation. A pump impeller is operatively mounted to the impeller shaft within the pump housing. The pump impeller is rotatable to draw the coolant into the pump housing through the inlet opening and discharge the coolant at a higher pressure through the outlet opening. It is preferable that this coolant pump be embodied in the combination described above.

The objective may also be achieved by providing the combination comprising a valve controlled piston and cylinder internal combustion engine having a piston driven output shaft and a valve actuating camshaft driven by the output shaft and a coolant system including a coolant flow path which passes through the engine in cylinder cooling relation and thereafter through a cooling zone. The coolant system includes a coolant pump comprising a pump housing within the flow path including an inlet opening configured and positioned to receive coolant from the flow path and an outlet opening configured and positioned to discharge coolant into the flow path. An impeller rotating structure is mounted directly to the camshaft so as to be rotatably driven thereby about an axis concentric to a rotational axis of the camshaft. A pump impeller is operatively mounted to the impeller rotating structure within the pump housing. The pump impeller is constructed and arranged to draw the coolant into the pump housing through the inlet opening and discharge the coolant at a higher pressure through the outlet opening during rotation thereof. A damper assembly is disposed within the pump housing and is rotatable to dampen torsional vibrations of the camshaft.

The objective may also be achieved by providing a coolant pump for use with an internal combustion engine having an output shaft. The coolant pump includes a pump housing including an inlet opening and an outlet opening. An impeller rotating structure is constructed and arranged to be operatively driven by the output shaft of the internal combustion engine about a rotational axis. A pump impeller is operatively mounted to the impeller rotating structure within the pump housing. The pump impeller is constructed and arranged to draw a coolant into the pump housing through the inlet opening and discharge the coolant at a higher pressure through the outlet opening during rotation thereof. A damper assembly is disposed within the pump housing and is constructed and arranged to dampen torsional vibrations of the impeller rotating structure.

In another aspect of the present invention, the pump housing is fixedly mounted to an outer casing of the engine thereby permitting the impeller shaft to be directly coupled to an opposite end of the camshaft to extend into the pump housing in an unsupported relation thereby eliminating the use of bearings in the coolant pump.

Other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF PREFERRED EMBODIMENTS

Figure 1:
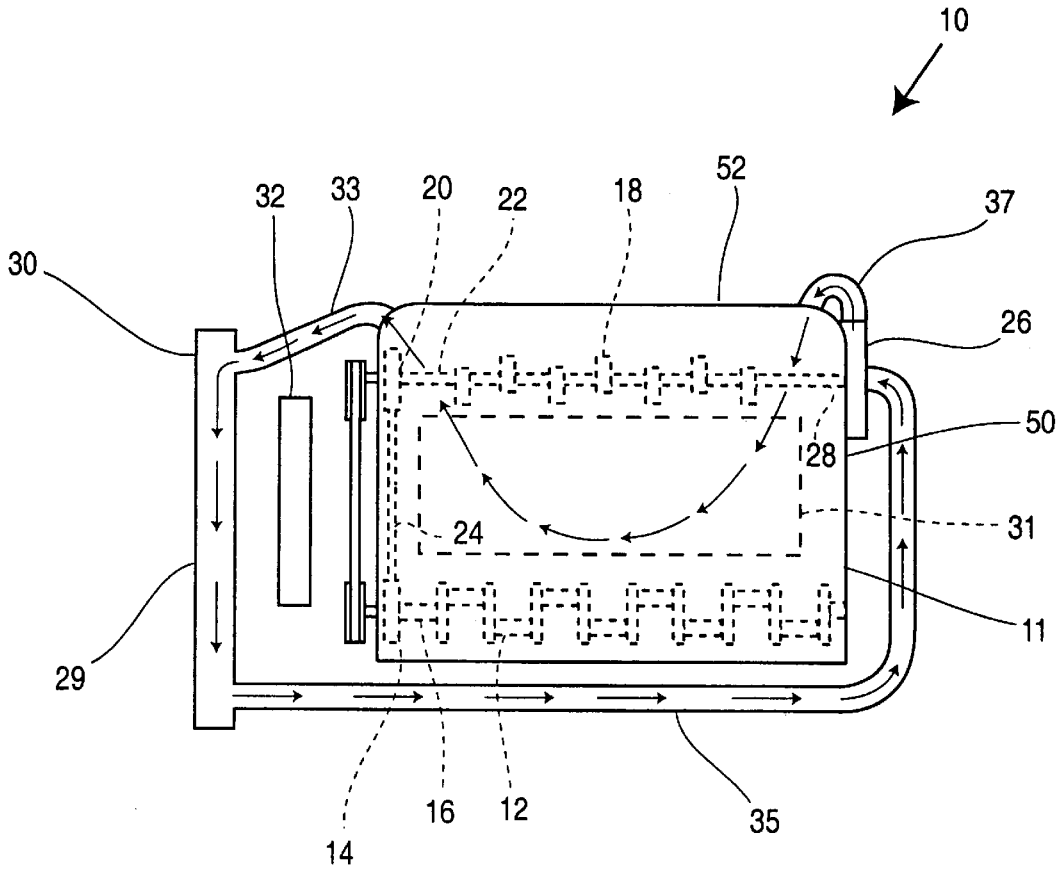
FIG. 1 is a schematic representation of an automobile internal combustion engine and a coolant system, the coolant system having a coolant pump embodying the principles of the present invention.

FIG. 1 is a schematic view illustrating a valve controlled piston and cylinder internal combustion engine 10 for an automobile. As is conventional, the engine 10 includes a piston driven output shaft 12, or crankshaft, having a driving sprocket or pulley 14 fixedly mounted thereto at one end 16 thereof. A valve actuating camshaft 18, which operates the valve mechanisms of the engine 10, has a driven sprocket or pulley 20 mounted thereto at one end 22 thereof. An endless chain or belt 24 is trained about the driving sprocket/pulley 14 of the crankshaft 12 and the driven sprocket/pulley 20 of the camshaft 18. The driven sprocket/pulley 20 receives driving force from the driving sprocket/pulley 14 via the chain/belt 24, which transmits such force to the camshaft 18. Thus, the camshaft 18 is coupled to the crankshaft 12 of the engine 10 so as to be driven by the crankshaft 12 and rotate under power from the engine 10. It should be understood that the internal combustion engine 10 may be of any known construction. It should also be understood the camshaft 18 may be driven by the crankshaft 12 with a compound drive, wherein more than one endless chain or belt is utilized to transmit driving force from the crankshaft 12 to the camshaft 18.

The present invention is more particularly concerned with a coolant pump 26, which is operatively connected to an opposite end 28 of the camshaft 18 of the engine 10 so as to be rotatably driven thereby. As is conventional, the coolant pump 26, also referred to as a water pump, forms a part of a closed-loop coolant system 29 of the automobile. The coolant system 29 of the automobile requires a steady flow of a coolant in order to remove excess heat from the engine 10. The coolant pump 26 circulates the coolant (preferably a mixture of glycol and water, or any other suitable liquid coolant) through a cooling jacket surrounding piston cylinders 31 of the engine 10 and a radiator 30. FIG. 1 illustrates a coolant flow path (represented with arrows) of the coolant which passes through the engine 10 in cylinder cooling relation and thereafter through a cooling zone defined by the radiator 30. Specifically, the coolant is pumped through the coolant jacket of the engine by the coolant pump 26 to absorb heat from the engine 10. Coolant exiting the coolant jacket is directed via flexible hoses or rigid piping 33 to the radiator 30 where the heat is dissipated to the flow of passing air. A fan 32, operatively driven by the output shaft 12 or a motor, is positioned and configured to facilitate the movement of air through the radiator 30 and carry away heat. The coolant cooled by the radiator 30 is then returned to the coolant pump 26 via flexible hoses or rigid piping 35 and circulated back through the coolant jacket to repeat the cycle.

A further understanding of the details of operation and of the components of the coolant system is not necessary in order to understand the principles of the present invention and thus will not be further detailed herein. Instead, the present invention is concerned in detail with the coolant pump 26 and how it is operatively connected to the camshaft 18 of the engine 10 and how it acts as a torsional vibration damper for the camshaft 18.

Figure 3:
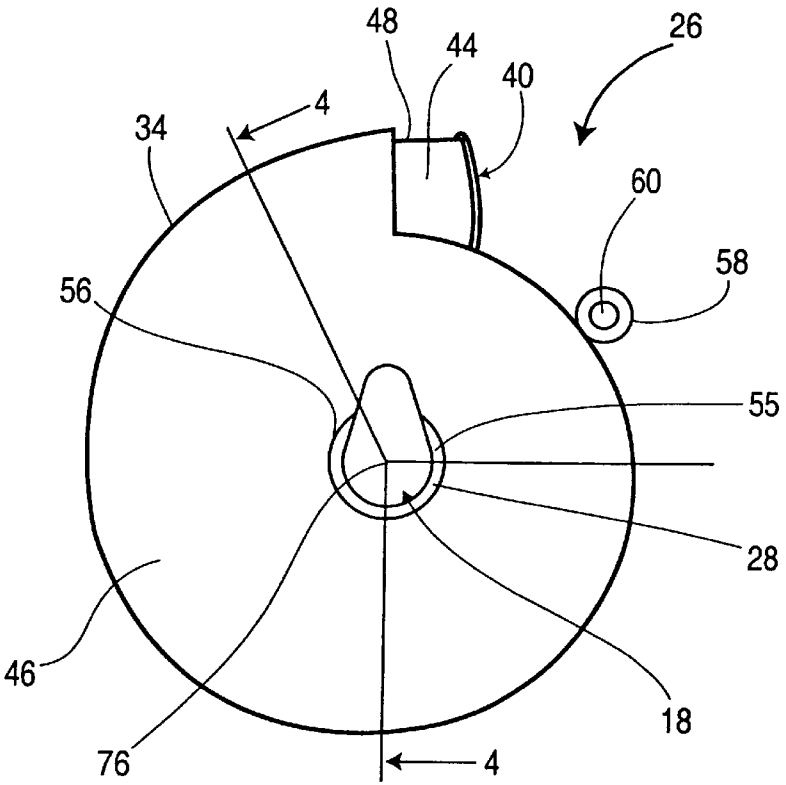
FIG. 3 is a back view of FIG. 2.
Figure 2:
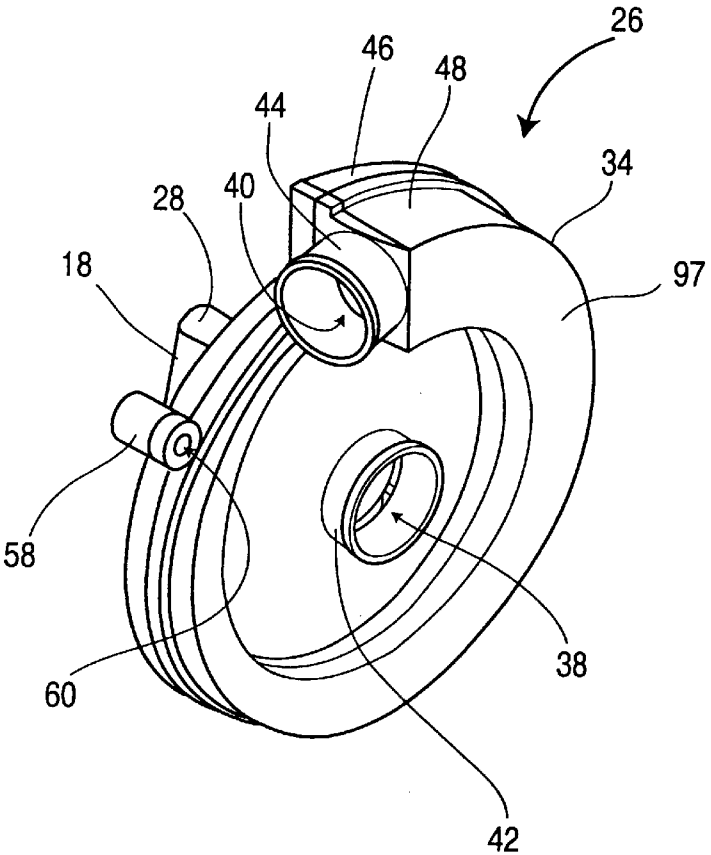
FIG. 2 is a perspective view of an embodiment of the coolant pump in accordance with the principles of the present invention.
Figure 4:
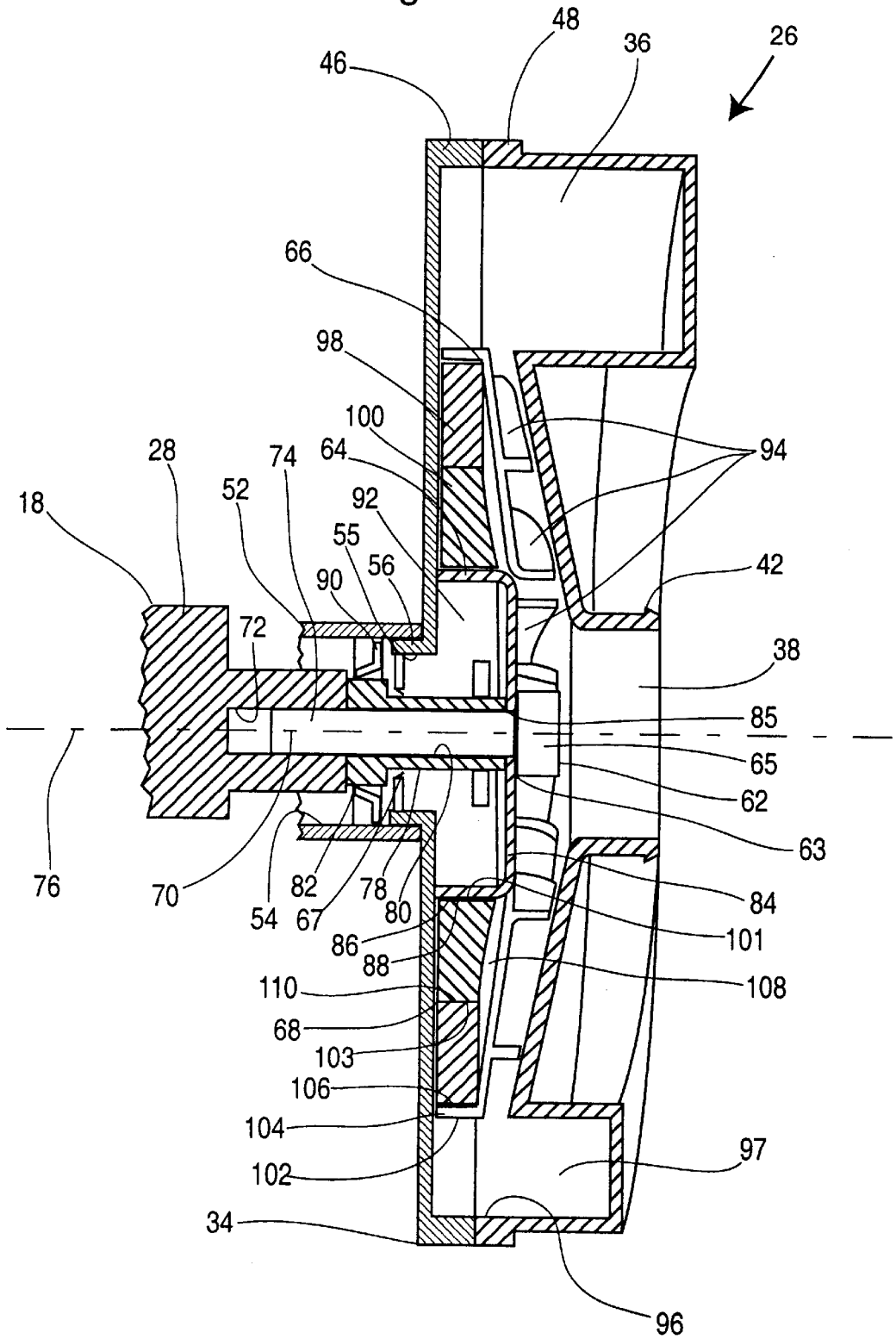
FIG. 4 is a cross-sectional view taken along line 4—4 of FIG. 3.

As illustrated in FIGS. 2–4, the coolant pump 26 includes a pump housing 34 enclosing an interior space 36. The housing 34, positioned within the coolant flow path, includes a generally cylindrical inlet opening 38 configured and positioned to receive coolant from the flow path and a generally cylindrical outlet opening 40 configured and positioned to discharge coolant into the flow path. The inlet opening 38 is communicated to the radiator 30 via flexible hoses or rigid piping 35 to enable coolant from the radiator 30 to enter the housing 34. The outlet opening 40 is communicated to the engine 10 via flexible hoses or rigid piping 37 so as to circulate the coolant from the radiator 30 through the coolant jacket to dissipate engine heat. The inlet and outlet openings 38, 40 have annular flanges 42, 44, respectively, which are positioned and configured to mount the flexible hoses or rigid piping 35, 37 necessary for communicating the coolant.

In the illustrated embodiment, the housing 34 is molded from plastic and comprises first and second sections 46, 48, with the annular flanges 42, 44 of the inlet and outlet openings 38, 40 being integrally formed with the second section 48. The first and second sections 46, 48 are secured together to define the interior space 36.

As illustrated in FIG. 1, the coolant pump 26 is fixedly mounted on a rear portion 11 of the engine 10 and is operatively connected to an opposite end 28 of the camshaft 18 of the engine 10 so as to be rotatably driven thereby. Specifically, the housing 34 is fixed in place to a rear portion 50 of a cylinder head 52 of the engine 10. The cylinder head 52 rotatably mounts the camshaft 18 and forms an upper part of the combustion chamber of the engine 10. As illustrated in FIG. 4, the cylinder head 52 has a pump shaft receiving opening 54. The first section 46 of the housing 34 has an opening 55 defining an annular cylinder head engaging flange portion 56, which is received within the pump shaft receiving opening 54 when mounted thereto. The housing 34 further includes a cylindrical portion 58 with a bore 60 therethrough, as shown in FIGS. 2–3. A fastener, such as a bolt, is inserted through the bore 60 and into a cooperating threaded bore within the rear portion 50 of the cylinder head 52 so as to secure the housing 34 to the cylinder head 52. Because there are no significant external loads applied to the housing 34, the housing 34 may be constructed of a light-weight plastic.

Referring now more particularly to FIG. 4, the interior space 36 of the housing 34 encloses a pump shaft 62 (also referred to as a pump shaft structure), a hub 64 (also referred to as a hub structure), a pump impeller 66, and a damper assembly 68.

The pump shaft 62 and the hub 64 can together be also referred to as an impeller assembly or impeller rotating structure 63. The pump shaft 62 is operatively connected to the camshaft 18 so as to be rotatably driven thereby about a shaft axis 70. In the illustrated embodiment, a fastener 65 and a shaft 67 constitute the pump shaft 62, the fastener 65 being mounted directly to the camshaft 18. The camshaft 18 has a bore 72 having threads thereon, which is coaxially aligned with the opening 54. The fastener 65 is inserted through the opening 54 such that a threaded portion 74 of the fastener 65 threadably engages the bore 72 so as to couple the fastener 65 and hence the pump shaft 62 with the camshaft 18. Thus, the shaft axis 70 is concentric to a rotational axis 76 of the camshaft 18. The shaft 67 has a generally cylindrical wall portion 78 defining an axially extending hole 80 for receiving the fastener 65. The shaft 67 includes an annular flange portion 82 that abuts against the camshaft 18.

Because the housing 34 is fixedly mounted in place to the cylinder head 52, the pump shaft 62 can be mounted directly to the camshaft 18 without the use of bearings. The pump shaft 62 extends into the housing 34 in an unsupported relation. The bearingless design makes the coolant pump 26 compact and economical.

The hub 64 is fixedly carried by the pump shaft 62 for rotation therewith about the shaft axis 70. Specifically, the hub 64 includes a radially outwardly extending portion 84 leading to a generally axially inwardly extending portion 86. The outwardly extending portion 84 has a hole 85 for receiving the fastener 65 such that the hub 64 is secured to the pump shaft 62 between an end of the wall portion 78 of the shaft 67 and the head of the fastener 65. The inwardly extending portion 86 includes an exterior engaging surface 88.

It is contemplated that the hub 64 and the shaft 67 are constructed as a single component, by welding the two pieces together for example. It is further contemplated that the shaft 67 of the single component may be mounted directly to the camshaft 18, without the need for the fastener 65. Thus, the single component shaft 67 and hub 64 would then itself constitute the impeller assembly 63.

An oil seal 90 is positioned between the flange portion 82 of the shaft 67 and the opening 54 of the cylinder head 52 so as to prevent lubricating oil in the cylinder head 52 from entering the housing 34 of the coolant pump 26. Oil seals are well known in the art and any seal that can perform the function noted above may be used.

A coolant seal 92 is positioned generally between the wall portion 78 and the outwardly and inwardly extending portions 84, 86 so as to prevent coolant within the housing 34 from entering the cylinder head 52 through the opening 54. The coolant seal 92 may be in the form of a spring-loaded seal assembly, as disclosed in U.S. Pat. No. 5,482,432 to Paliwoda et al. However, it is contemplated that the coolant seal 92 may be of any construction that can perform the function noted above.

The pump impeller 66 is operatively mounted to the hub 64 within the pump housing 34. The pump impeller 66 is constructed and arranged to draw the coolant into the pump housing 34 through the inlet opening 38 and discharge the coolant at a higher pressure through the outlet opening 40 during rotation thereof. The impeller 66 is operatively mounted to the hub 64 so as to rotate under power from the engine 10 such that the impeller 66 may force the flow of coolant through the cooling system during operation of the engine 10.

The impeller 66 is generally cylindrical and includes a plurality of blades 94. As is conventional with centrifugal pumps, the coolant is drawn into the center of the impeller 66 via the inlet opening 38, which is also coaxial with the shaft axis 70. The coolant flows into the rotating blades 94, which spin the coolant around at high speed sending the coolant outward due to centrifugal force to an inner peripheral surface 96 defined by the first and second sections 46, 48 of the housing 34. As the coolant engages the inner peripheral surface 96, the coolant is raised to a higher pressure before it leaves the outlet opening 40. As illustrated in FIGS. 2–3, the outlet opening 40 is tangent to an outer periphery of the housing 34.

It should also be noted that the inner peripheral surface 96 forms an upper wall of a volute 97, or spiraling portion, of the housing 34. As illustrated in FIG. 4, the volute 97 is generally rectangular in cross-section. However, the volute 97 may have a rounded cross-section, such as a circular or oval cross-section. As the volute 97 spirals around the outer periphery of the housing 34 towards the outlet opening 40 as shown in FIGS. 2 and 4, the cross-section of the volute 97 gradually increases. As a result, the volute 97 maintains a constant fluid velocity, which facilitates the flow of coolant.

The damper assembly 68 is disposed between the hub 64 and the pump impeller 66. The damper assembly 68 is constructed and arranged to couple the hub 64 and the pump impeller 66 together so that powered rotation of the camshaft 18 rotates the pump impeller 66 via the hub 64 fixedly carried by the pump shaft 62. The damper assembly 68 also acts as a torsional vibration damper for the camshaft 18.

The damper assembly 68 comprises an annular inertia ring 98 and an elastomeric ring structure 100. The inertia ring 98 is fixedly mounted to the impeller 66. Thus, the impeller 66 and inertia ring 98 form a one piece rigid structure. Specifically, the impeller 66 has an axially inwardly extending flange portion 102 at the outer periphery thereof. An outer cylindrical surface 104 of the inertia ring 98 is mounted to an inner surface 106 of the flange portion 102 such that the inertia ring 98 extends generally radially inwardly towards the hub 64. As a result, an annular space 108 is defined between the hub 64 and the inertia ring 98.

The elastomeric ring 100 is positioned within the space 108 between the hub 64 and the inertia ring 98. The elastomeric ring 100 is constructed and arranged to retain the coupling of the inertia ring 98 and hence the impeller 66 on the hub 64. The elastomeric ring 100 also absorbs the torsional vibrations occurring within the camshaft 18. The elastomeric ring 100 is constructed of a polymeric material that has material characteristics for absorbing vibrations, such as rubber.

Specifically, the elastomeric ring 100 has inner and outer cylindrical surfaces 101, 103, respectively. The elastomeric ring 100 is secured within the space 108 such that the inner cylindrical surface 101 engages the exterior engaging surface 88 of the hub 64 and the outer cylindrical surface 103 engages an inner cylindrical surface 110 of the inertia ring 98. The surfaces 101, 103 of the elastomeric ring 100 may be bonded to the surfaces 88, 110, respectively, by an adhesive for example. The elastomeric ring 100 may also be secured in position due to its springiness. The elastomeric ring 100 is self-biased in a free state such that the thickness of the elastomeric ring 100 is larger than the space 108 defined between the exterior engaging surface 88 of the hub 64 and the inner cylindrical surface 110 of the inertia ring 98. Thus, when the elastomeric ring 100 is positioned within the space 108, the surfaces 101, 103 of the elastomeric ring 100 and the surfaces 88, 110, respectively, are in continuous biased engagement. Thus, the inertia ring 98 and hence the impeller 66 mounted thereto is secured to the hub 64.

Consequently, the coolant pump 26 is connected to the camshaft 18 by the pump shaft 62 and the shaft axis 70, or rotational axis of the pump shaft 62, is coaxial with the rotational axis 76 of the camshaft 18. Hence, driving movement of the camshaft 18 in a rotational direction causes the pump shaft 62 to be rotated in a similar direction. Because the hub 64 is fixed to the pump shaft 62, the hub 64 is driven in the same direction. As a result, the elastomer ring 100 is also driven in the rotational direction, which in turn drives the inertia ring 98 to rotate the impeller 66 in the rotational direction. During this driving operation, torsional vibrations occurring within the camshaft 18 will be transmitted to the pump shaft 62 and the hub structure 64. Because the inertia ring 98 and hence the impeller 66 is mounted on the hub 64 by the elastomeric ring 100, the torsional vibrations will be absorbed or damped by the elastomeric ring 100. The inertia ring 98 and hence the impeller 66 may move relative to the hub 64 about the shaft axis 70 as the elastomeric ring 100 damps vibrations. It should also be noted that the coolant can also be used as a damping fluid on the impeller 66. The reduced torsional vibrations results in reduced wear on the camshaft and components associated therewith.

Figure 14:
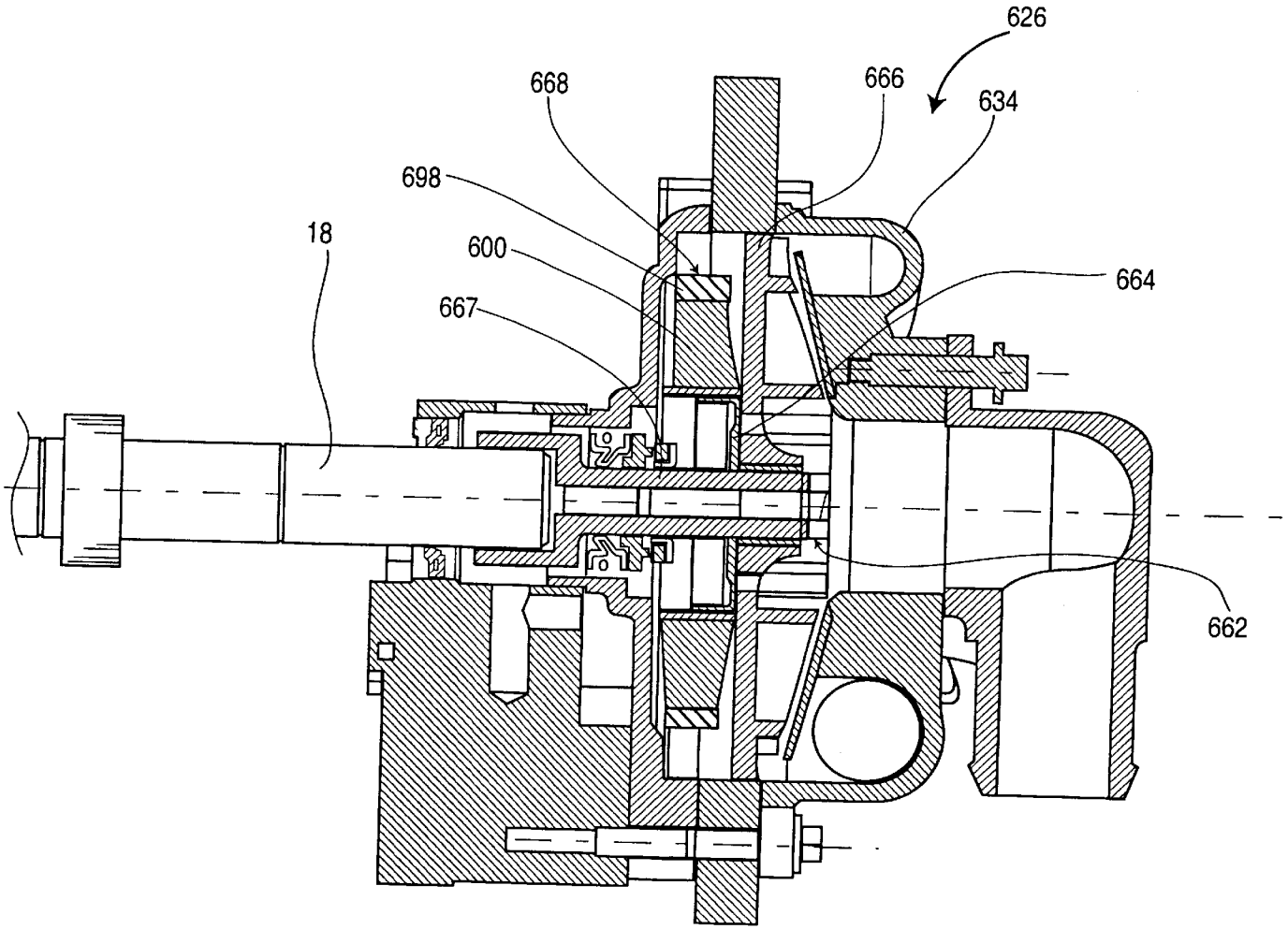
FIG. 14 is a cross-sectional view of another embodiment of the coolant pump.

It is contemplated that the elastomeric ring 100 may be replaced by one or more mechanical springs constructed of steel. The spring or springs would retain the coupling of the inertia ring 98 and hence the impeller 66 on the hub 64. The coolant would be used as a damping fluid on the impeller 66. It is also contemplated that other known types of torsional damper assemblies (e.g., viscous dampers, pendulum dampers, or Lanchester dampers) may be utilized in the present invention. For example, FIG. 14 illustrates a further embodiment of the coolant pump, indicated as 626. In this embodiment, the impeller 666 is secured directly to the shaft 667 of the pump shaft 662. A hub 664 is secured to the impeller 666. The damper assembly 668 is mounted to the impeller 666 via the hub 664. Specifically, the elastomeric ring 600 of the damper assembly 668 is positioned on the outer peripheral surface of the hub 664. The inertia ring 698 of the damper assembly 668 is positioned on the outer peripheral surface of the elastomeric ring 600 to retain the coupling of the elastomeric ring 600 on the hub 664 and hence the elastomeric ring 600 on the impeller 666. As a result, the elastomeric ring 600 absorbs the torsional vibrations occurring within the camshaft 18.

Figure 5:
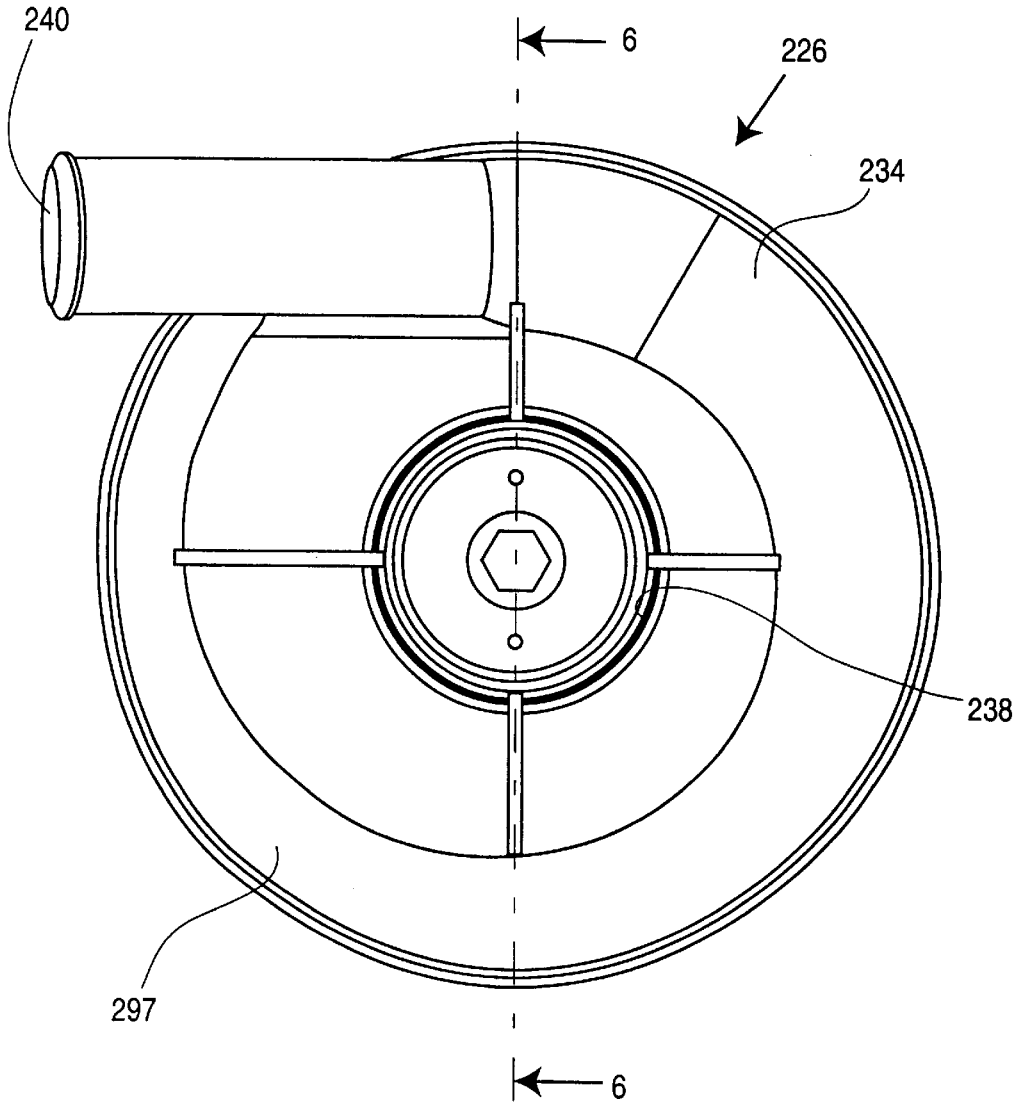
FIG. 5 is a front view of another embodiment of the coolant pump.
Figure 6:
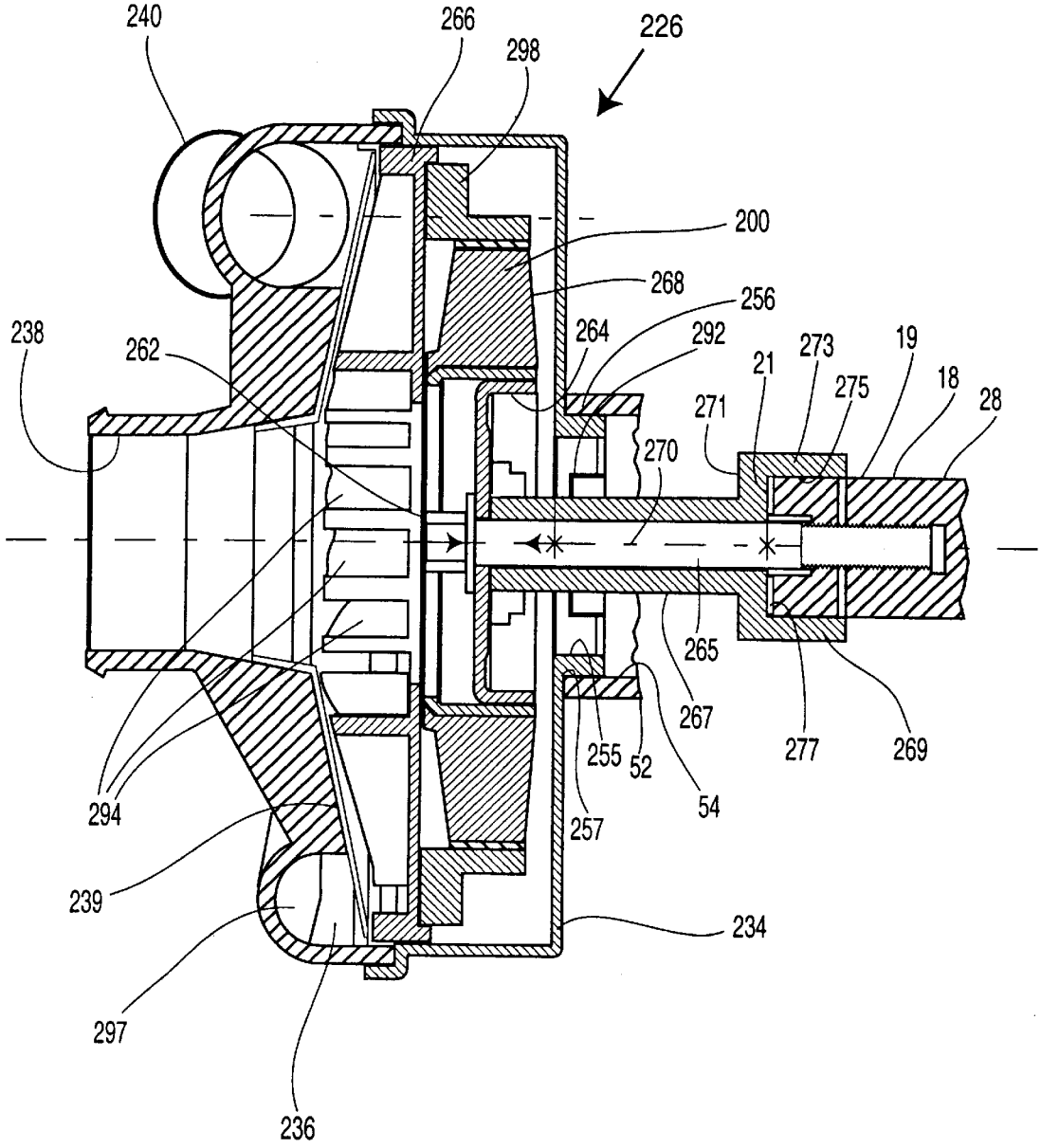
FIG. 6 is a cross-sectional view taken along line 6—6 of FIG. 5.

A further embodiment of the coolant pump, indicated as 226, is illustrated in FIGS. 5–6. In this embodiment, the housing 234 and the impeller 266 have been changed to enable a smaller pump diameter with respect to the previous embodiment to be used for a given impeller size. The remaining elements of the coolant pump 226 are similar to the elements of the coolant pump 26 and are indicated with similar reference numerals.

Similar to the previous embodiment, the housing 234 includes inlet and outlet openings 238, 240 configured to mount the flexible hoses or rigid piping necessary for communicating the coolant. The inlet opening 238 is coaxial with the shaft axis 270 and the outlet opening 240 is tangent to an outer periphery of the housing 234.

The interior space 236 of the housing 234 encloses the pump shaft 262, the hub 264, the pump impeller 266, and the damper assembly 268. As in the previous embodiment, a fastener 265 and a shaft 267 constitute the pump shaft 262. However, in contrast to the shaft 67 of the previous embodiment, the shaft 267 of the embodiment shown in FIG. 6 includes a cup-shaped portion 269 that engages the camshaft 18. Specifically, the cup-shaped portion 269 of the shaft 267 includes a radially outwardly extending portion 271 leading to a generally axially outwardly extending portion 273. The_shaft 267 is engaged with the camshaft 18 such that the inner peripheral surface 275 of the axially outwardly extending portion 273 engages the exterior peripheral surface 19 of the camshaft 18 and the inner surface 277 of the radially outwardly extending portion 271 engages the end surface 21 of the camshaft 18.

A seal assembly 292 is positioned between the shaft 267 and the opening 255 of the housing 234 to prevent coolant within the housing 234 from entering the cylinder head 52 through the opening 54. The seal assembly 292 also prevents lubricating oil in the cylinder head 52 from entering the housing 234 of the coolant pump 226. The seal assembly 292 may be of any construction that can perform the function noted above.

The pump impeller 266 is operatively mounted to the hub 264 within the pump housing 234 in a similar manner as described in the previous embodiment. Specifically, the annular inertia ring 298 of the damper assembly 268 is fixedly mounted to the impeller 266. The elastomeric ring 200 of the damper assembly 268 is positioned between the hub 264 and the inertia ring 298 to retain the coupling of the inertia ring 298 and hence the impeller 266 on the hub 264. The elastomeric ring 200 also absorbs the torsional vibrations occurring within the camshaft 18.

In contrast to the previous embodiment, the impeller 266 includes a plurality of blades 294 configured and positioned to draw coolant into the center of the impeller 266 via the inlet opening 238 and send the coolant axially outwardly into the volute 297 defined by the housing 234.

In the embodiment of coolant pump 26 described above, the volute 97 is positioned around the periphery of the impeller 66 and the coolant is discharged in the radial direction from the impeller 66 into the volute 97. In the embodiment of coolant pump 234 illustrated in FIGS. 5–6, the impeller 266 is configured such that the coolant is discharged in the axial direction into the volute 297. Accordingly, the housing 234 is configured such that the volute 297 extends axially from the periphery of the impeller 266. Further, the housing 234 includes an annular guide plate 239 fixed thereto. The guide plate 239 forms a part of the volute 297 to facilitate the flow of coolant through the volute 297 and out the outlet opening 240.

Because the volute 297 does not extend radially outwardly from the periphery of the impeller 266, but rather axially outwardly, a smaller pump diameter with respect to the previous embodiment can be used for a given impeller size. This helps reduce the amount of space necessary for the pump.

Figure 7:
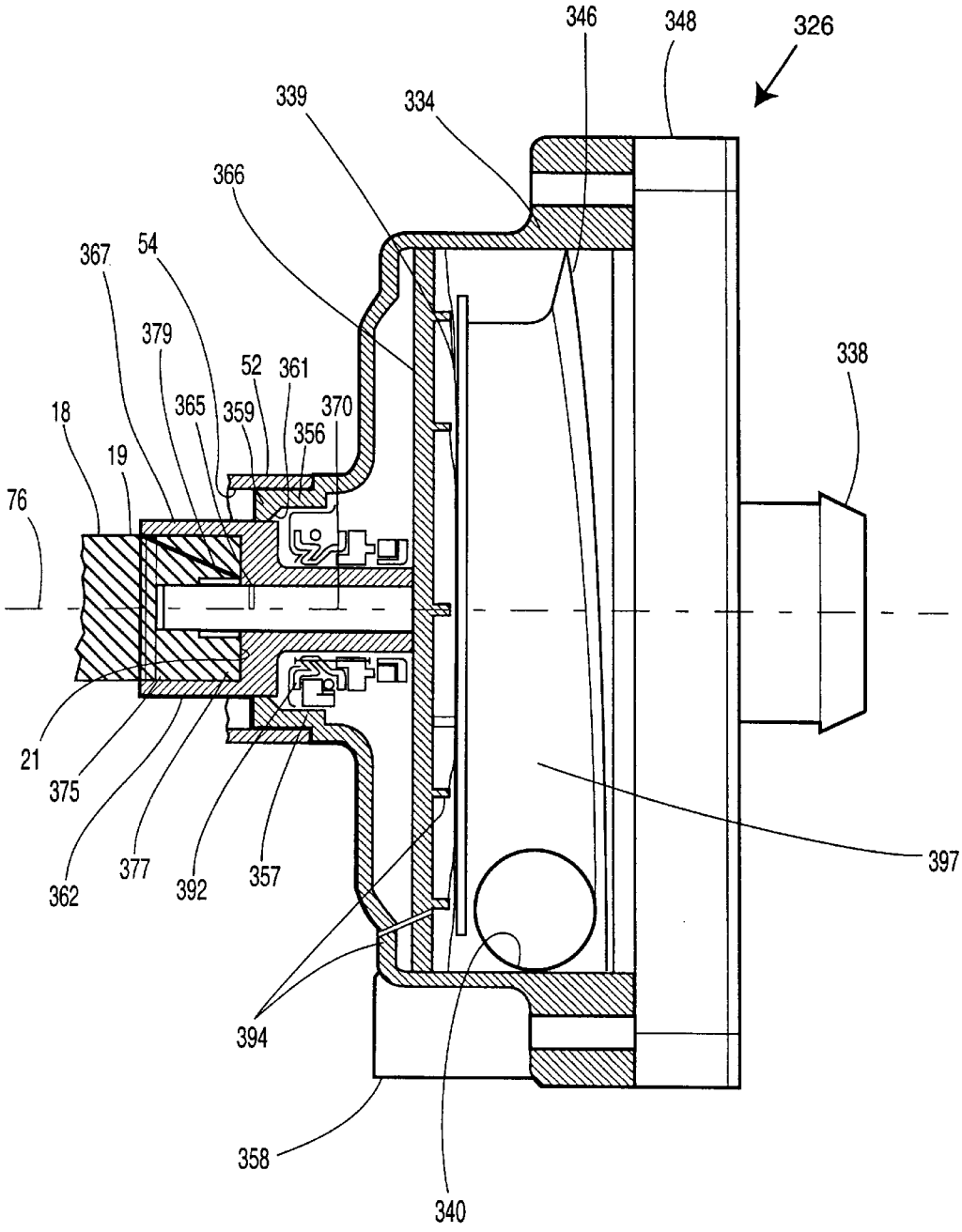
FIG. 7 is a cross-sectional view of another embodiment of the coolant pump.

FIG. 7 illustrates another embodiment of the coolant pump, indicated as 326. Similar to the embodiment of coolant pump 226 described above, the impeller 366 and the housing 334 are configured to discharge coolant in the axial direction into the volute 397. In contrast, this embodiment illustrates a means for eliminating the guide plate 239 that was included in the housing 234 of the coolant pump 226 described above. In this embodiment, a damper assembly is not present. Thus, the impeller 366 is secured between the shaft 367 and the fastener 365 of the pump shaft 362. Alternatively, the impeller 366 may be integrally formed with the shaft 367. A damper assembly may be provided and mounted between the impeller 266 and the pump shaft 362 in a similar manner as described above.

As shown in FIG. 7, the housing 334 is integrally formed with a volute 397 having an annular guide surface 339 adjacent the blades 394 of the impeller 366. Specifically, the volute 397 is integrally formed with the outlet opening 340 in the first section 346 of the housing 334 with the inlet opening 338 formed with the second section 348 of the housing 334. The volute 397 and guide surface 339 thereof may be integrally formed with the housing 334 by using radial slides in the mould, for example. In the previous embodiment, the volute 297 was formed by both the sections of the housing 234 and the guide plate 239. Because the guide plate 239 is replaced with guide surface 339 which is integrally formed with the housing 334, the number of components is reduced which facilitates manufacturing and assembly.

FIG. 7 also illustrates another means for installing the pump to the engine 10. In the previous embodiment, the pump 226, being bearingless, utilizes the inner surfaces 275, 277 of the shaft 267 and the peripheral surface 257 of the flange 256 of the housing 234 to align the pump 226 with the camshaft 18 and the opening 54 in the cylinder head 52.

As shown in FIG. 7 the flange 356 of the housing 334 is provided with an inwardly extending portion 359 that provides a support surface 361 to facilitate installation of the pump 326 to the engine 10. The support surface 361 temporarily supports the housing 334 as the shaft 367 and the fastener 365 are operatively engaged with the camshaft 18, as will be discussed below. The support surface 361 properly aligns the housing 334 with the camshaft 18 and the opening 54 in the cylinder head 52, regardless of the tolerances of the pump components, camshaft 18, and the cylinder head 52.

Referring to FIG. 7, when the pump 326 is installed to the engine 10, the inner surface 375 of the shaft 367 is first engaged with the camshaft 18 in order to center the shaft axis 370 with the axis 76 of the camshaft 18. Then, the fastener 365 is tightened, which brings the inner surface 377 into engagement with the end surface 21 of the camshaft 18. As the inner surface 377 is moved towards the end surface 21 of the camshaft 18, the support surface 361 of the housing 334 maintains engagement with the outer peripheral surface 379 of the shaft 367 so as to maintain the radial alignment between the shaft 367 and the housing 334. As a result, the engagement between the peripheral surface 357 of the housing 334 and the opening 54 in the cylinder head 52 is not relied on for alignment. The shaft 367 extends into the housing 334 in an unsupported relation. Once the fastener 365 is secured, the fastener receiving portions 358 of the housing 334 are secured to the cylinder head 52 to secure the housing 334 in position. The mounting of the housing 334 to the cylinder head 52 establishes the axial location and perpendicularity between the shaft 367 and housing 334. When the engine 10 is operating, no significant external loads are applied to the housing 334. As a result, the pump 326 can be constructed without the use of bearings. Any significant external loads are applied to the bearings of the camshaft 18. Thus, the running accuracy is provided by the camshaft bearings only. Further, because there are no external loads applied to the housing 334, the housing 334 can be constructed of non-metallic materials, such as plastic.

Figure 8:
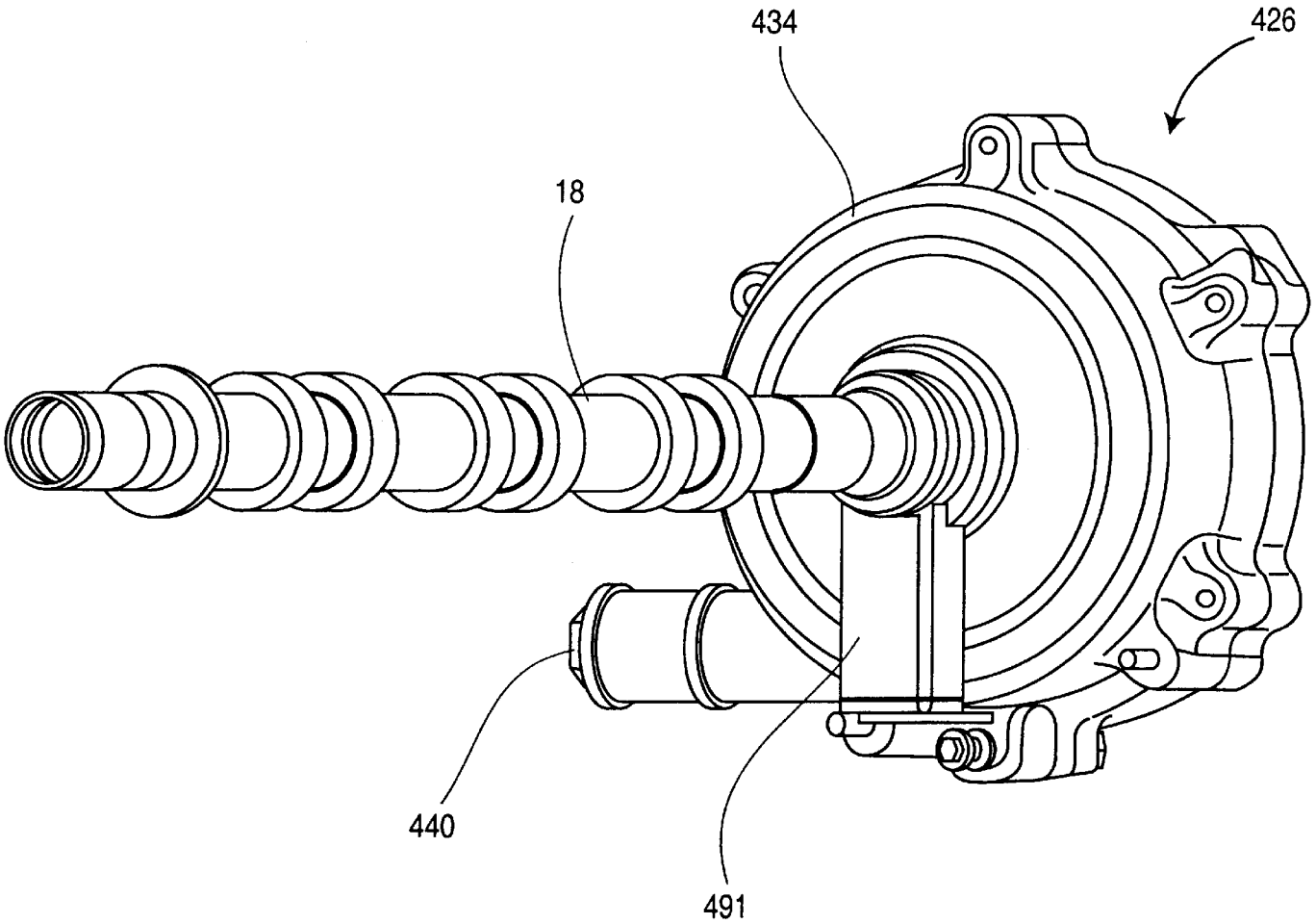
FIG. 8 is a perspective view of another embodiment of the coolant pump.
Figure 9:
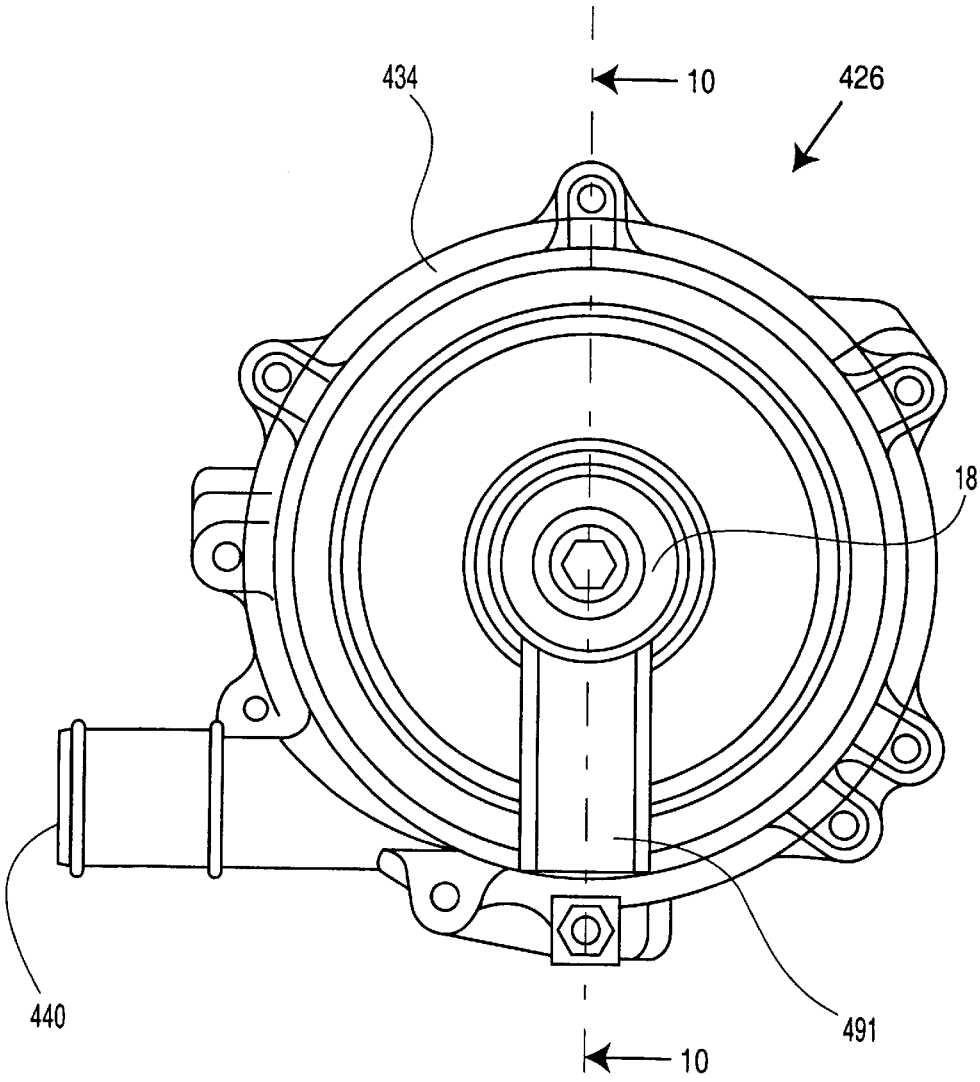
FIG. 9 is a back view of FIG. 8.
Figure 10:
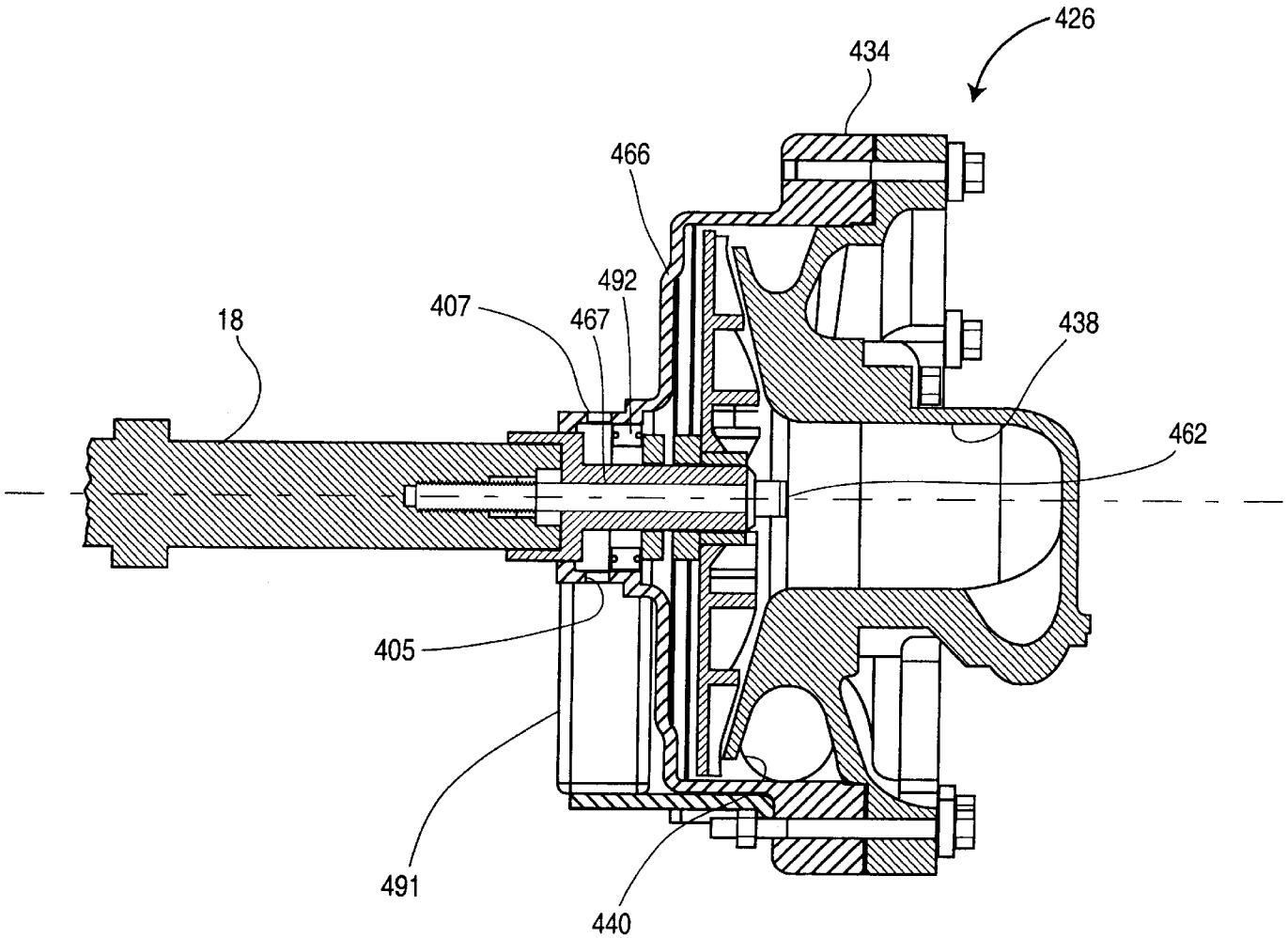
FIG. 10 is a cross-sectional view taken along line 10—10 of FIG. 9.

FIGS. 8–10 illustrate another embodiment of the coolant pump, indicated as 426. In this embodiment, the coolant pump 426 includes a reservoir 491 that provides a place for coolant to accumulate and evaporate, as will be discussed below. Similar to the embodiment of coolant pump 326, the coolant pump 426 does not include a damper assembly. Specifically, the impeller 466 is secured directly to the shaft 467 of the pump shaft 462. A damper assembly may be provided and mounted between the impeller 466 and the pump shaft 462 in a similar manner as described above.

As aforesaid, the reservoir 491 provides a place for coolant to accumulate and evaporate. More specifically, the seal assembly 492 of the pump 426 is typically designed so that there is a small coolant leak between the shaft 467 and the housing 434. The housing 434 is provided with a slot 405 that allows the leaked coolant to enter the reservoir 491 for collection. The reservoir 491 includes one or more vents such that the collected coolant can evaporate. Further, the reservoir 491 includes an overflow hole 407 in case the seal assembly 492 fails and coolant completely fills up the reservoir 491. The reservoir 491 provides a means for monitoring the seal assembly 492 for major leaks.

In the illustrated embodiment, the reservoir 491 is a separate component from the housing 434 and is secured thereto in operative relation. A separate reservoir 491 has several advantages. For example, the reservoir 491 may be constructed of a different material than the material used for the housing 434. Further, the angular relationship between the housing 434 and the reservoir 491 may be changed without extensive tooling modifications. Moreover, a separate reservoir 491 provides more freedom in creating intricate reservoir shapes.

Figure 11:
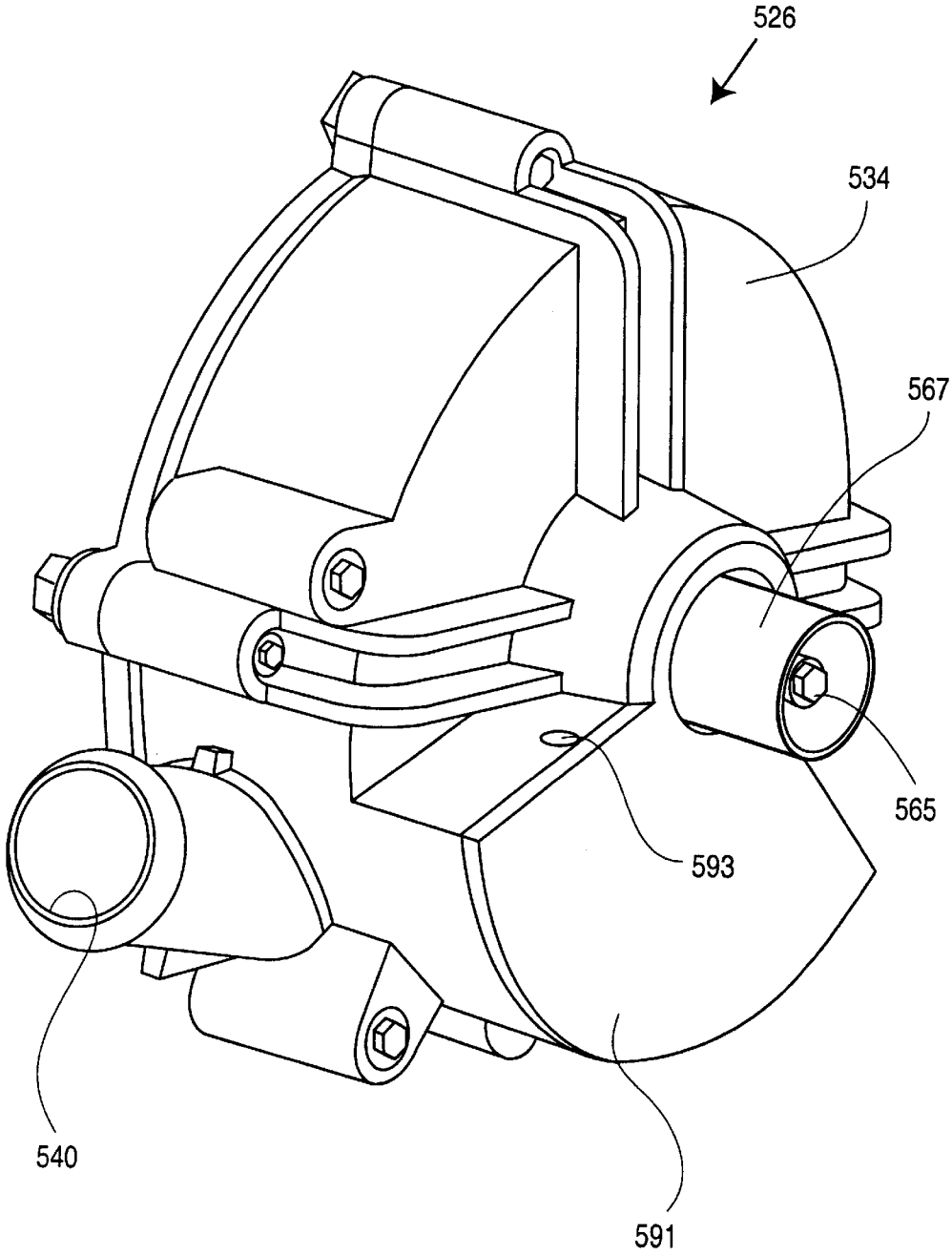
FIG. 11 is a perspective view of another embodiment of the coolant pump.
Figure 12:
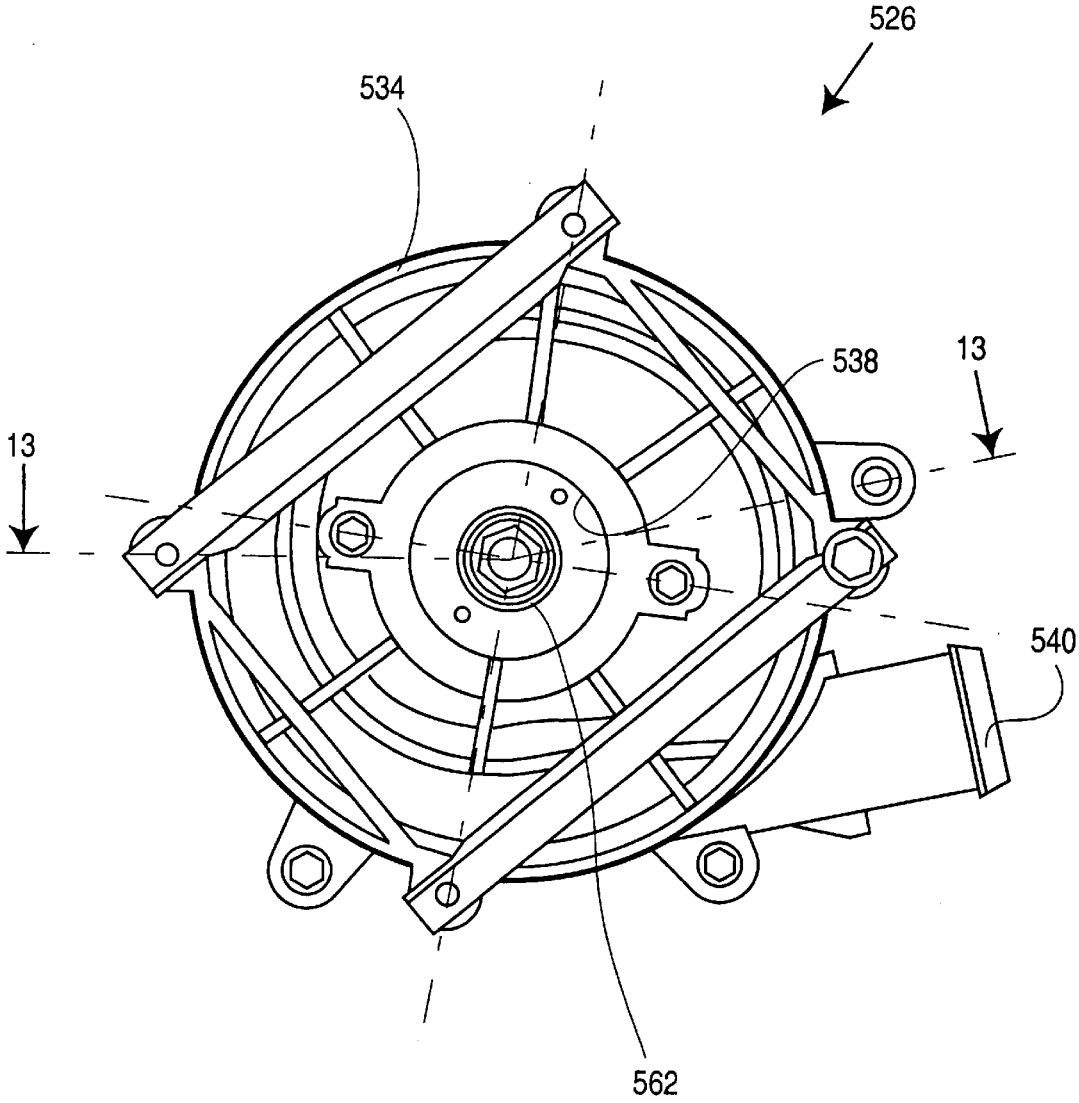
FIG. 12 is a front view of FIG. 11.
Figure 13:
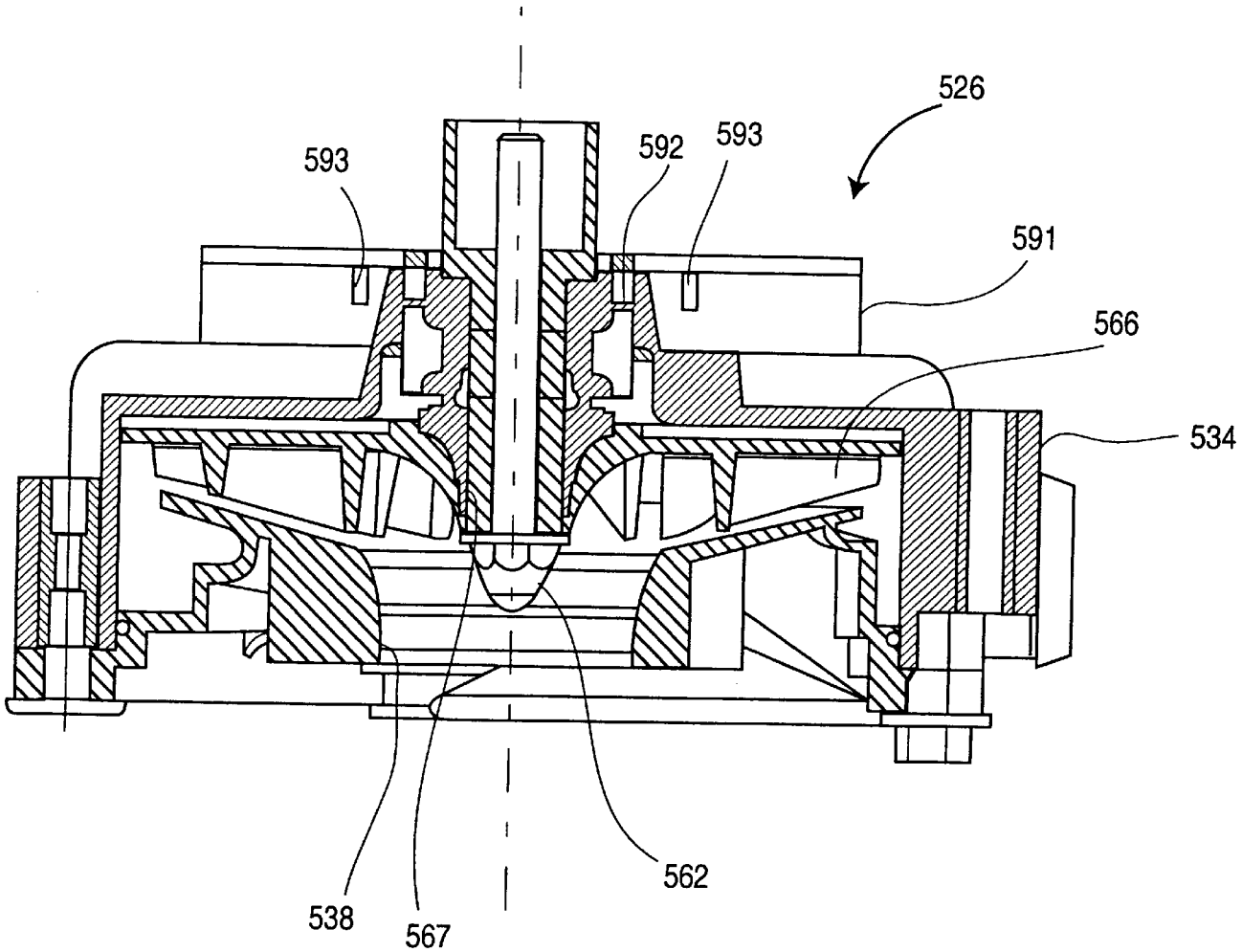
FIG. 13 is a cross-sectional view taken along line 13—13 of FIG. 12.

FIGS. 11–13 illustrate another embodiment of the coolant pump, indicated as 526, in which a reservoir 591 is integrally formed with the housing 534. Similar to the embodiment of coolant pumps 326 and 426, the coolant pump 526 does not include a damper assembly. Specifically, the impeller 566 is secured directly to the shaft 567 of the pump shaft 562. A damper assembly may be provided and mounted between the impeller 566 and the pump shaft 562 in a similar manner as described above.

In the illustrated embodiment, the housing 534 and reservoir 591 thereof are molded of plastic as a single component. Similar to the embodiment of coolant pump 426, the housing 534 of pump 526 includes a slot to allow coolant to enter the reservoir 591 and an overflow hole in case the seal assembly 592 fails. The slot and hole of the housing 534 may be integrally formed with the housing 534 or may be mechanically formed in a separate operation by drilling, for example. Further, as shown in FIGS. 11 and 13, the reservoir 591 includes rectangular-shaped vents 593 for evaporating the collected coolant.

An advantage of the coolant pump 26, 226 of the present invention is that it performs two functions. The coolant pump 26, 226 operates as a standard centrifugal water pump and acts as a torsional vibration damper for the camshaft 18. The damper assembly 68, 268 also improves engine noise vehicle harshness (NVH).

Another advantage of the present invention is that the coolant pump 26, 226, 326, 426, 526 is directly driven by the opposite end 28 of camshaft 18. As a result, space at the front portion of the engine 10 will be less confined.

Still another advantage of the present invention is that the coolant pump 26, 226, 326, 426, 526 is constructed and arranged to be mounted to the camshaft and rotatably supported within the housing without the use of bearings.

It can thus be appreciated that the objectives of the present invention have been fully and effectively accomplished. The foregoing specific embodiments have been provided to illustrate the structural and functional principles of the present invention and are not intended to be limiting. To the contrary, the present invention is intended to encompass all modifications, alterations, and substitutions within the spirit and scope of the appended claims.

What is claimed is:

1. A coolant pump for use with an internal combustion engine having a crankshaft and a camshaft driven by the crankshaft, said coolant pump comprising:

a pump housing fixedly mountable to the engine and including an inlet opening to receive coolant and an outlet opening to discharge coolant;

an impeller shaft mounted directly to the camshaft so as to be concentrically rotatably driven thereby, said impeller shaft extending into said housing in a sealing engagement and in an unsupported relation;

a pump impeller operatively mounted to the impeller shaft within the pump housing, the pump impeller rotatable to draw the coolant into the pump housing through the inlet opening and discharge the coolant at a higher pressure through the outlet opening; and a damper assembly disposed between the impeller shaft and the pump impeller, the damper assembly coupling the impeller shaft to the pump impeller so that powered rotation of the impeller shaft rotates the pump impeller.

2. The coolant pump according to claim 1, wherein the damper assembly comprises:

an annular inertia ring fixedly mounted to the impeller; and an elastomeric structure coupling the impeller shaft to the inertia ring.

3. The coolant pump according to claim 1, wherein the housing is integrally formed with a volute, the volute having a guide surface configured and positioned to facilitate the flow of coolant through the volute and out the outlet opening.

4. The coolant pump according to claim 3, wherein the impeller includes a plurality of blades configured and positioned to draw coolant into the housing via the inlet opening and discharge the coolant via the outlet opening.

5. The coolant pump according to claim 1, further comprising a reservoir constructed and arranged to collect coolant that leaks from the housing.

6. The coolant pump according to claim 5, wherein the reservoir is a separate component from the housing and is secured thereto in operative relation.

7. The coolant pump according to claim 5, wherein the reservoir is integrally formed with the housing.

8. The coolant pump according to claim 5, wherein the housing includes a seal assembly constructed and arranged to prevent coolant from entering the engine and directs leaking coolant from the seal assembly to the reservoir.

9. The coolant pump according to claim 5, wherein the housing includes a seal assembly constructed and arranged to prevent coolant from egressing from the housing and directs leaking coolant from the seal assembly to the reservoir.

10. The coolant pump according to claim 1, wherein the housing includes a seal assembly constructed and arranged to prevent oil from ingressing into the housing.

11. The coolant pump according to claim 1, wherein the housing is plastic.

12. A coolant pump for use with an internal combustion engine having a crankshaft and a camshaft having opposing first and second ends with the first end being driven by the crankshaft, said coolant pump comprising:

a pump housing fixedly mountable to the engine and including an inlet opening to receive coolant and an outlet opening to discharge coolant;

an impeller shaft detachably mounted directly to the second end of the camshaft opposite the first end and being concentrically rotatably driven thereby, said impeller shaft extending into said housing in a sealing engagement and in an unsupported relation; and a pump impeller operatively mounted to the impeller shaft within the pump housing, the pump impeller rotatable to draw the coolant into the pump housing through the inlet opening and discharge the coolant at a higher pressure through the outlet opening.

13. The coolant pump according to claim 1, wherein the pump housing encloses the pump impeller.

14. A coolant pump for use with an internal combustion engine having a crankshaft and a camshaft driven by the crankshaft, said coolant pump comprising:

a pump housing fixedly mountable to the engine and including an inlet opening to receive coolant and an outlet opening to discharge coolant;

an impeller shaft mounted directly to the camshaft so as to be concentrically rotatably driven thereby, said impeller shaft extending into said housing in a sealing engagement and in an unsupported relation; and a pump impeller operatively mounted to the impeller shaft within the pump housing, the pump impeller rotatable to draw the coolant into the pump housing through the inlet opening and discharge the coolant at a higher pressure through the outlet opening, wherein the housing includes a support surface configured and positioned to engage the impeller shaft so as to maintain radial alignment between the impeller shaft and the housing as the impeller shaft is being mounted to the camshaft of the engine, thereafter the housing being fixedly mounted to the engine spacing the support surface from the impeller shaft.

15. A combination comprising:

an internal combustion engine having a crankshaft and a camshaft having opposing first and second ends with the first end being driven by the crankshaft, and a coolant pump comprising:

a pump housing fixedly mountable to the engine and including an inlet opening to receive coolant and an outlet opening to discharge coolant;

an impeller shaft detachably mounted directly to the second end of the camshaft opposite the first end and being concentrically rotatably driven thereby, said impeller shaft extending into said housing in a sealing engagement and in an unsupported relation; and a pump impeller operatively mounted to the impeller shaft within the pump housing, the pump impeller rotatable to draw the coolant into the pump housing through the inlet opening and discharge the coolant at a higher pressure through the outlet opening.

16. The combination according to claim 15, wherein the pump housing encloses the pump impeller.

17. A combination comprising:

an internal combustion engine having a crankshaft and a camshaft driven by the crankshaft, and a coolant pump comprising:

a pump housing fixedly mountable to the engine and including an inlet opening to receive coolant and an outlet opening to discharge coolant;

an impeller shaft mounted directly to the camshaft so as to be concentrically rotatably driven thereby, said impeller shaft extending into said housing in a sealing engagement and in an unsupported relation;

a pump impeller operatively mounted to the impeller shaft within the pump housing, the pump impeller rotatable to draw the coolant into the pump housing through the inlet opening and discharge the coolant at a higher pressure through the outlet opening; and a damper assembly disposed between the impeller shaft and the pump impeller, the damper assembly coupling the impeller shaft to the pump impeller so that powered rotation of the impeller shaft rotates the pump impeller.

18. The combination according to claim 17, wherein the damper assembly comprises:

an annular inertia ring fixedly mounted to the impeller; and an elastomeric structure coupling the impeller shaft to the inertia ring.

19. The combination according to claim 18, further comprising a reservoir constructed and arranged to collect coolant leaking from the housing.

20. The combination according to claim 19, wherein the housing includes a seal assembly constructed and arranged to prevent coolant from entering the engine and directs leaking coolant from the seal assembly to the reservoir.

21. The combination according to claim 20, wherein the housing includes a support surface configured and positioned to engage the impeller shaft so as to maintain radial alignment between the impeller shaft and the housing as the impeller shaft is being mounted to the camshaft of the engine, and thereafter the housing being fixedly mounted to the engine spacing the support surface from the impeller shaft.

22. The combination comprising:

a valve controlled piston and cylinder internal combustion engine having a piston driven output shaft and a valve actuating camshaft driven by the output shaft; and a coolant system including a coolant flow path which passes through the engine in cylinder cooling relation and thereafter through a cooling zone, the coolant system including a coolant pump comprising:

a pump housing within the flow path including an inlet opening configured and positioned to receive coolant from the flow path and an outlet opening configured and positioned to discharge coolant into the flow path;

an impeller rotating structure mounted directly to the camshaft so as to be rotatably driven thereby about an axis concentric to a rotational axis of the camshaft;

a pump impeller operatively mounted to the impeller rotating structure within the pump housing, the pump impeller being constructed and arranged to draw the coolant into the pump housing through the inlet opening and discharge the coolant at a higher pressure through the outlet opening during rotation thereof; and a damper assembly disposed within the pump housing and being rotatable to dampen torsional vibrations of the camshaft.

23. The combination according to claim 22, wherein the damper assembly is disposed between the impeller rotating structure and the pump impeller, the damper assembly being constructed and arranged to couple the impeller rotating structure and the pump impeller together so that powered rotation of the impeller rotating structure rotates the pump impeller via the impeller rotating structure.

24. The combination according to claim 23, wherein the damper assembly comprises:

an annular inertia ring fixedly mounted to the impeller; and an elastomeric structure positioned between the impeller rotating structure and the inertia ring constructed and arranged to retain the coupling of the inertia ring and hence the impeller on the impeller rotating structure, wherein torsional vibrations occurring within the camshaft are absorbed by the elastomeric structure.

25. The combination according to claim 22, wherein the pump housing is fixedly mounted to an outer casing of the engine thereby permitting the impeller rotating structure to be directly coupled to the camshaft without the use of bearings.

26. The combination according to claim 22, wherein the impeller includes a plurality of blades configured and positioned to draw coolant into the housing via the inlet opening and discharge the coolant radially outwardly into a volute defined by the housing, the volute communicating with the outlet opening.

27. The combination according to claim 22, wherein the impeller includes a plurality of blades configured and positioned to draw coolant into the housing via the inlet opening and discharge the coolant axially outwardly into a volute defined by the housing, the volute communicating with the outlet opening.

28. The combination according to claim 27, wherein the housing includes an annular guide plate fixed thereto that forms a part of the volute.

29. The combination according to claim 27, wherein the housing is integrally formed with the volute, the volute having a guide surface configured and positioned to facilitate the flow of coolant through the volute and out the outlet opening.

30. The combination according to claim 29, wherein the volute and guide surface thereof are integrally formed with the housing by using radial slides in the mould.

31. The combination according to claim 22, wherein the housing includes a support surface configured and positioned to engage the impeller rotating structure so as to maintain radial alignment between the impeller rotating structure and the housing as the impeller rotating structure is being mounted to the camshaft of the engine, thereafter the housing being fixedly mounted to an outer casing of the engine thereby permitting the impeller rotating structure to be directly coupled to the camshaft without the use of bearings.

32. The combination according to claim 22, further comprising a reservoir constructed and arranged to collect coolant that leaks from the housing.

33. The combination according to claim 32, wherein the reservoir is a separate component from the housing and is secured thereto in operative relation.

34. The combination according to claim 32, wherein the reservoir is integrally formed with the housing.

35. The combination according to claim 32, wherein the housing includes a seal assembly constructed and arranged to prevent coolant from entering the engine and wherein coolant that leaks from the seal assembly is collected by the reservoir.

36. A coolant pump for use with an internal combustion engine having an output shaft, the coolant pump comprising:

a pump housing including an inlet opening and an outlet opening;

an impeller rotating structure constructed and arranged to be operatively driven by the output shaft of the internal combustion engine about a rotational axis;

a pump impeller operatively mounted to the impeller rotating structure within the pump housing, the pump impeller being constructed and arranged to draw a coolant into the pump housing through the inlet opening and discharge the coolant at a higher pressure through the outlet opening during rotation thereof; and a damper assembly disposed within the pump housing and being constructed and arranged to dampen torsional vibrations of the impeller rotating structure.

37. A coolant pump according to claim 36, wherein the damper assembly is disposed between the impeller rotating structure and the pump impeller, the damper assembly being constructed and arranged to couple the impeller rotating structure and the pump impeller together so that powered rotation of the impeller rotating structure rotates the pump impeller.

38. A coolant pump according to claim 37, wherein the damper assembly comprises:

an annular inertia ring fixedly mounted to the impeller; and an elastomeric structure positioned between the impeller rotating structure and the inertia ring constructed and arranged to retain the coupling of the inertia ring and hence the impeller on the impeller rotating structure, wherein torsional vibrations occurring within the impeller rotating structure are absorbed by the elastomeric structure.

39. A coolant pump according to claim 36, wherein the internal combustion engine includes a rotatable camshaft coupled to the output shaft so as to rotate under power from the engine, the impeller rotating structure being mounted directly to the camshaft so as to be rotatably driven thereby and wherein the rotational axis is concentric to a rotational axis of the camshaft.

40. A coolant pump according to claim 39, wherein the housing includes a support surface configured and positioned to engage the impeller rotating structure so as to maintain radial alignment between the impeller rotating structure and the housing as the impeller rotating structure is being mounted to the camshaft of the engine, thereafter the housing being fixedly mounted to an outer casing of the engine thereby permitting the impeller rotating structure to be directly coupled to the camshaft without the use of bearings.

41. A coolant pump according to claim 36, wherein the impeller includes a plurality of blades configured and positioned to draw coolant into the housing via the inlet opening and discharge the coolant radially outwardly into a volute defined by the housing, the volute communicating with the outlet opening.

42. A coolant pump according to claim 36, wherein the impeller includes a plurality of blades configured and positioned to draw coolant into the housing via the inlet opening and discharge the coolant axially outwardly into a volute defined by the housing, the volute communicating with the outlet opening.

43. A coolant pump according to claim 42, wherein the housing includes an annular guide plate fixed thereto that forms a part of the volute.

44. A coolant pump according to claim 42, wherein the housing is integrally formed with the volute, the volute having a guide surface configured and positioned to facilitate the flow of coolant through the volute and out the outlet opening.

45. A coolant pump according to claim 44, wherein the volute and guide surface thereof are integrally formed with the housing by using radial slides in the mould.

46. A coolant pump according to claim 36, further comprising a reservoir constructed and arranged to collect coolant that leaks from the housing.

47. A coolant pump according to claim 46, wherein the reservoir is a separate component from the housing and is secured thereto in operative relation.

48. A coolant pump according to claim 46, wherein the reservoir is integrally formed with the housing.

49. A coolant pump according to claim 46, wherein the housing includes a seal assembly constructed and arranged to prevent coolant from entering the engine and wherein coolant that leaks from the seal assembly is collected by the reservoir.

50. The combination comprising:

a valve controlled piston and cylinder internal combustion engine having a piston driven output shaft and a valve actuating camshaft, the camshaft having opposing first and second ends with the first end being driven by the output shaft; and a coolant system including a coolant flow path which passes through the engine in cylinder cooling relation and thereafter through a cooling zone, the coolant system including a coolant pump comprising:

a pump housing within the flow path including an inlet opening configured and positioned to receive coolant from the flow path and an outlet opening configured and positioned to discharge cool ant into the flow path;

an impeller rotating structure detachably mounted directly to the second end of the camshaft opposite the first end and being rotatably driven thereby about an axis concentric to a rotational axis of the camshaft;

a pump impeller operatively mounted to the impeller rotating structure within the pump housing, the pump impeller being constructed and arranged to draw the coolant into the pump housing through the inlet opening and discharge the coolant at a higher pressure through the outlet opening during rotation thereof, wherein the pump housing is fixedly mounted to an outer casing of the engine thereby permitting the impeller rotating structure to be directly coupled to the second end of the camshaft without the use of bearings.

51. The combination according to claim 50, further comprising a damper assembly disposed between the impeller rotating structure and the pump impeller, the damper assembly being constructed and arranged to (a) couple the impeller rotating structure and the pump impeller together so that powered rotation of the camshaft rotates the pump impeller via the impeller rotating structure, and (b) act as a torsional vibration damper for the camshaft.

52. The combination according to claim 51, wherein the damper assembly comprises:

an annular inertia ring fixedly mounted to the impeller; and an elastomeric structure positioned between the impeller rotating structure and the inertia ring constructed and arranged to retain the coupling of the inertia ring and hence the impeller on the impeller rotating structure, wherein torsional vibrations occurring within the camshaft are absorbed by the elastomeric structure.

53. The combination according to claim 50, wherein the impeller includes a plurality of blades configured and positioned to draw coolant into the housing via the inlet opening and discharge the coolant radially outwardly into a volute defined by the housing, the volute communicating with the outlet opening.

54. The combination according to claim 50, wherein the impeller includes a plurality of blades configured and positioned to draw coolant into the housing via the inlet opening and discharge the coolant axially outwardly into a volute defined by the housing, the volute communicating with the outlet opening.

55. The combination according to claim 54, wherein the housing includes an annular guide plate fixed thereto that forms a part of the volute.

56. The combination according to claim 54, wherein the housing is integrally formed with the volute, the volute having a guide surface configured and positioned to facilitate the flow of coolant through the volute and out the outlet opening.

57. The combination according to claim 56, wherein the volute and guide surface thereof are integrally formed with the housing by using radial slides in the mould.

58. The combination according to claim 50, wherein the housing includes a support surface configured and positioned to engage the impeller rotating structure so as to maintain radial alignment between the impeller rotating structure and the housing as the impeller rotating structure is being mounted to the camshaft of the engine, thereafter the housing being fixedly mounted to an outer casing of the engine thereby permitting the impeller rotating structure to be directly coupled to the second end of the camshaft without the use of bearings.

59. The combination according to claim 50, further comprising a reservoir constructed and arranged to collect coolant that leaks from the housing.

60. The combination according to claim 59, wherein the reservoir is a separate component from the housing and is secured thereto in operative relation.

61. The combination according to claim 59, wherein the reservoir is integrally formed with the housing.

62. The combination according to claim 59, wherein the housing includes a seal assembly constructed and arranged to prevent coolant from entering the engine and wherein coolant that leaks from the seal assembly is collected by the reservoir.

63. The combination according to claim 50, wherein the pump housing encloses the pump impeller.

* * * * *